US006126402A

United States Patent [19]

Fisher et al.

[11] Patent Number: 6,126,402

[45] **Date of Patent: *Oct. 3, 2000**

[54] AIR COMPRESSOR SYSTEM

[75] Inventors: Lynn E. Fisher; James V. Yu, both of Fort Wayne, Ind.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/916,017

[22] Filed: Aug. 21, 1997

[51] Int. Cl.[7] ..... F04B 49/06

[52] U.S. Cl. ..... 417/45; 417/294; 417/42; 417/45; 310/68 E

[58] Field of Search ..... 417/294, 42, 45; 310/68 E

[56] References Cited

U.S. PATENT DOCUMENTS

| | | | |
|---|---|---|---|
| 2,462,232 | 2/1949 | Stein | 417/27 |
| 2,629,537 | 2/1953 | Graybrook et al. | 417/18 |
| 3,609,421 | 9/1971 | Hildebrandt | 310/68 E |
| 5,293,090 | 3/1994 | Heilman et al. | 310/68 E |

FOREIGN PATENT DOCUMENTS

| | | | |
|---|---|---|---|
| 55-727676 | 5/1980 | Japan | 417/294 |
| 57-126582 | 8/1982 | Japan | 417/294 |

OTHER PUBLICATIONS

Grainger, General Catalog No. 380, p. 1593, Dec. 1991.

*Primary Examiner*—Charles G. Freay
*Assistant Examiner*—David J. Torrente
*Attorney, Agent, or Firm*—Welsh & Katz, Ltd.; Carl B. Horton, Esq.; Wayne O. Traynham, Esq.

[57] ABSTRACT

An air compressor system having an unloader valve which is directly mechanically activated by an air compressor motor's centrifugal mechanism to allow the motor to reach a predetermined speed before a load is applied is disclosed. The unloader valve is mounted directly on an end flange of the motor and communicates with an outlet conduit of the air compressor to allow the compressed air from the air compressor to vent to atmosphere until the motor reaches the predetermined speed.

2 Claims, 3 Drawing Sheets

AIR COMPRESSOR SYSTEM

FIELD OF THE INVENTION

The present invention generally relates to air compressor systems and, more particularly, to an inexpensive, portable air compressor system having an unloader valve which is directly mechanically activated by the air compressor motor's centrifugal mechanism to allow the motor to reach a predetermined speed before a full load is applied.

BACKGROUND OF THE INVENTION

Air compressor systems typically utilize a valve, commonly referred to as an unloader valve, to temporarily allow air that is compressing under normal start-up conditions to vent directly to the atmosphere instead of into an air storage tank to reduce the load initially applied to the motor and compressor. The spring-biased stem of a typical unloader valve is mechanically activated by a pressure switch which is part of the total compressor system. The pressure switch activates the unloader valve at initial start-up or during steady state off conditions when the pressure in the air storage tank rises above a predetermined level.

Two air compressor systems that utilize a solenoid to actuate an unloader valve are disclosed in the prior art references discussed hereafter. U.S. Pat. No. 2,462,232 to Stein discloses an air compressor system having a control means which utilizes the voltage across the capacitor of a single-phase motor to actuate an unloader valve. Referring to the only Figure disclosed in this reference, a motor 1 directly drives a compressor 2 and a speed responsive switch 8 via motor shaft 10. When the motor runs below a predetermined speed, there is no load on the motor 1 because a switch 8 electrically connects the capacitor 7 to the solenoid 14 thereby opening a valve 13 and venting the compressed air to atmosphere. During this time, the switch 8 also energizes the auxiliary winding 3. When the motor reaches the predetermined speed, switch 8 disconnects the auxiliary winding 3 from an external power source and disconnects solenoid 14 from capacitor 7 thereby closing valve 13 and allowing the tank (not shown) to fill with compressed air.

U.S. Pat. No. 2,629,537 to Graybrook et al. discloses a system for controlling the operation of electric motors which drive fluid compressors. When the air pressure in the main reservoir 11 drops below a predetermined level, the pressure switch 16 closes a battery circuit which energizes the motor 14. Simultaneously, the coil 55 of the magnet valve 17 is energized which actuates the valve member 56 and allows the air in the auxiliary reservoir 24 and the valve lifter 41 to be exhausted through a restricted opening 59 in the magnet valve 17. The motor is allowed to reach full speed before the compressor 10 begins pumping against the head pressure in the main reservoir 11.

Air compressor systems that utilize a solenoid to actuate an unloader valve are expensive to manufacture, maintain and use. For example, not only are the material costs increased due to providing a solenoid activated unloader valve and the electrical connections which provide power to the solenoid, but also labor costs are increased due to the time required for mounting and interconnecting the various parts together. Additionally, for example, maintenance and use costs also are increased due to the provision of the additional moving parts.

SUMMARY OF THE INVENTION

It is desirable to provide an air compressor system having an unloader valve which is directly mechanically activated by an air compressor motor's centrifugal mechanism to allow the motor to reach a predetermined speed before a load is applied. The unloader valve may, for example, be mounted directly on an end flange of the motor and communicate with the high pressure outlet conduit of the air compressor.

Direct mechanical activation of the unloader valve by the an air compressor motor's centrifugal mechanism has a number of advantages. First, the costs needed to manufacture such an air compressor system are significantly lower because, for example, a solenoid and the necessary supporting components and electrical connections are not utilized. Second, labor costs are lowered because less time is required to completely assemble the air compressor system due to the lower number of component parts. Third, existing air compressor systems can be retrofitted to include the benefits of the present invention simply by replacing the motor's end flange with one that includes an unloader valve with an actuator that contacts the motor's centrifugal mechanism.

Other features and advantages of the invention will become apparent from the description that follows.

DETAILED DESCRIPTION OF THE INVENTION

Figure 1:
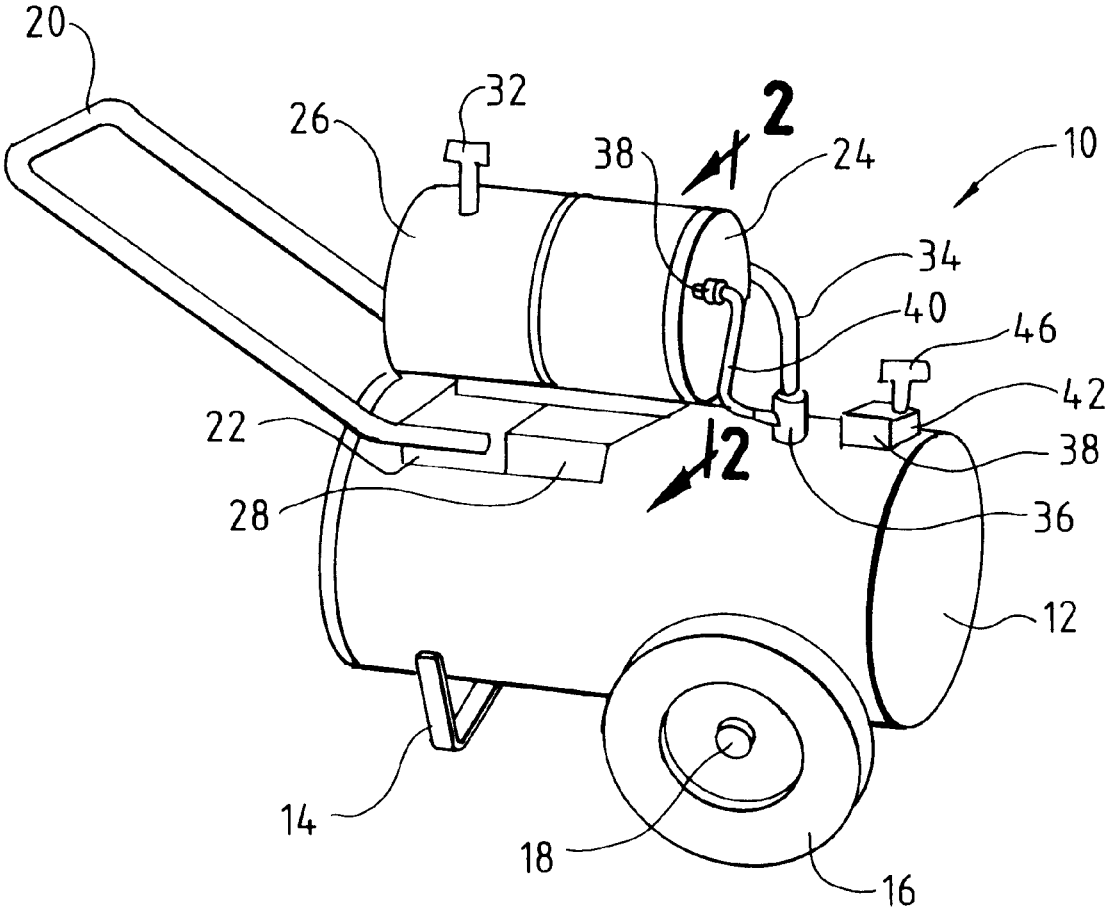
FIG. 1 is a perspective view of a portable air compressor system according to an embodiment of the present invention.

Referring now to FIG. 1, a perspective view of a portable air compressor system 10 according to the present invention is shown. Air compressor system 10 includes an air storage tank 12 that is supported on a surface (not shown) by a support 14 and wheels 16 which are mounted on tank 12 via axle 18. A handle 20 is mounted on tank 12 via bracket 22 so that the air compressor system 10 can be moved.

Figure 2A:
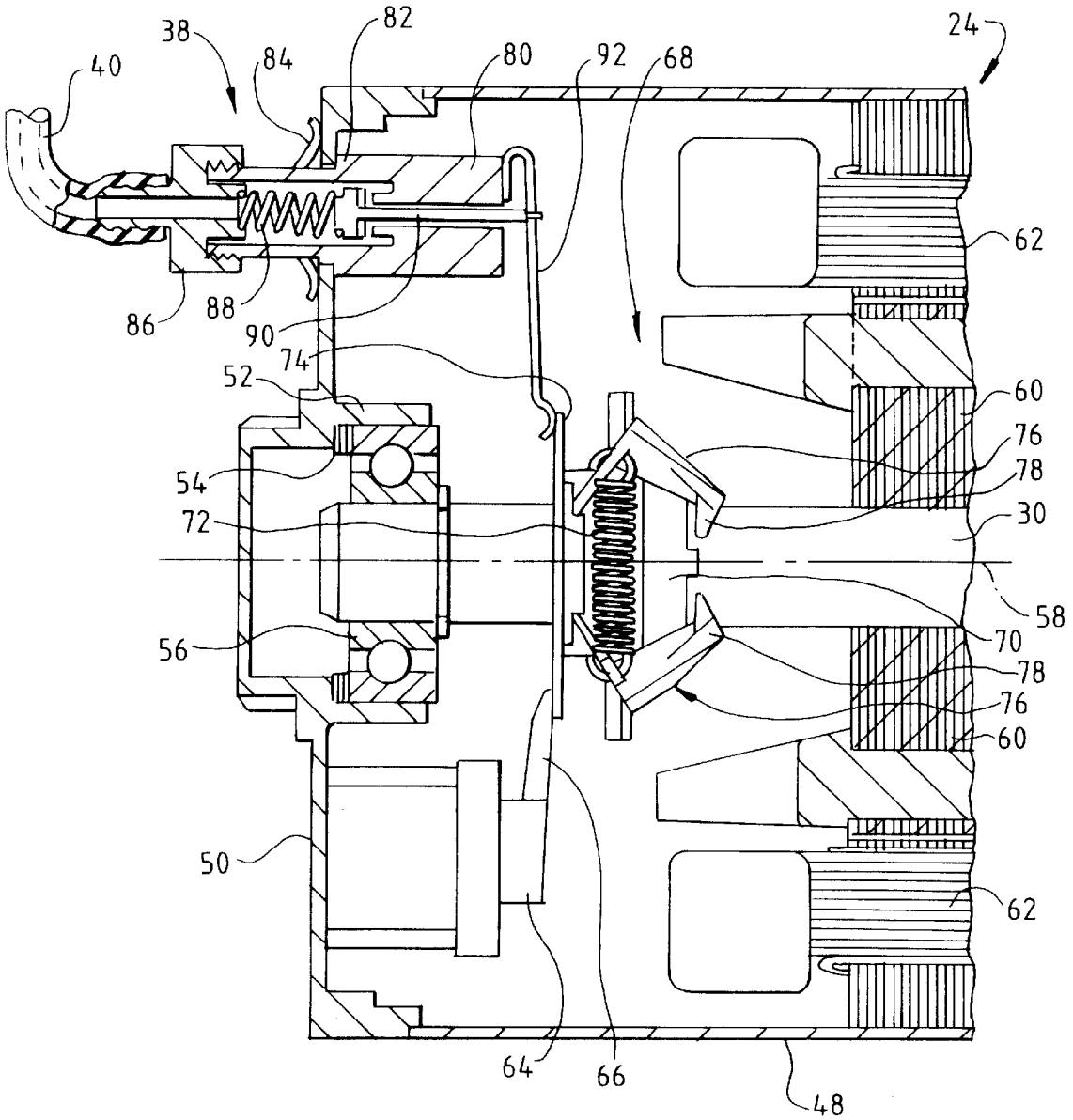
FIGS. 2A and 2B are partial sectional views taken along lines 2—2 in FIG. 1 which show an unloader valve directly mechanically actuated by the air compressor motor's centrifugal mechanism.
Figure 2B:
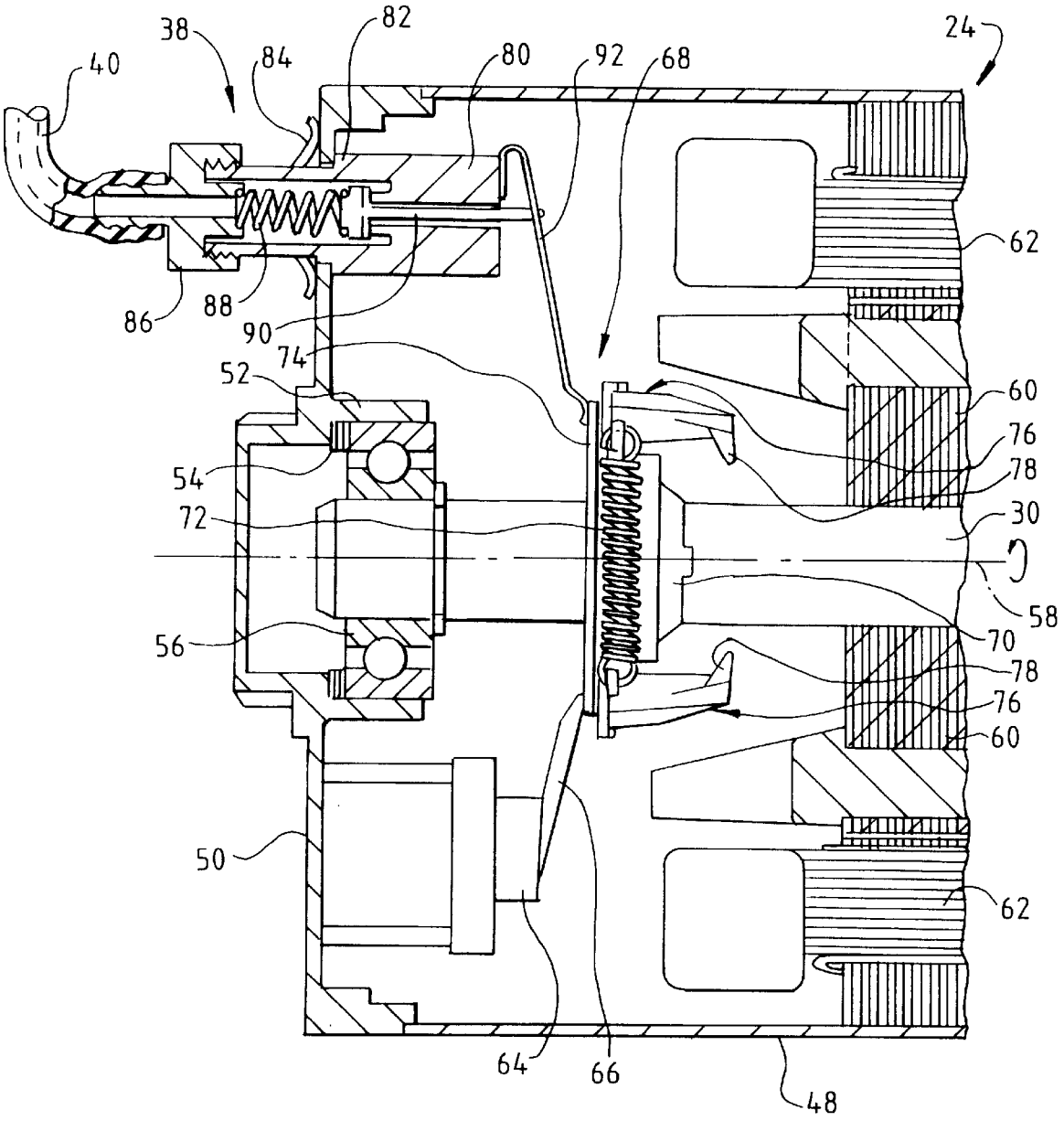

An electric motor 24 and an air compressor 26 are mounted on tank 12 by brackets 22 and 28. Motor 24 is operatively engaged with the air compressor 26 via a shaft 30 (FIGS. 2A and 2B). Air compressor 26 includes an air intake 32 and an outlet conduit 34 which communicates with the air storage tank 12 via check valve 36. Check valve 36 allows the outlet conduit 34 to communicate with an unloader valve 38 and precludes the flow of compressed air from the tank 12 towards either the air compressor 26 or the unloader valve 38. Unloader valve 38 is spring-biased to an open position shown in FIG. 2A and is moveable to the closed position shown in FIG. 2B as discussed in greater detail hereafter. Alternatively, check valve 36 may be connected to a supply conduit (not shown) to allow an air storage container such as, for example, a pneumatic vehicle tire to be filled with compressed air.

A pressure switch 42 communicates with tank 12 and is electrically connected to the primary and start windings of the motor 24 via a line 44. Pressure switch 42 includes an adjustable relief valve 46 which is connected to the air storage tank 12 to vent the compressed air contained therein to atmosphere if the pressure inside the tank 12 rises above a predetermined, desired level.

FIGS. 2A and 2B are partial sectional views taken along lines 2-2 in FIG. I which show that an unloader valve is directly mechanically actuated by the air compressor motor's centrifugal mechanism. Electric motor 24 includes an outer housing 48 and an end flange 50 which has a tubular seat 52 for receiving a bearing bush 54 and a bearing 56. A motor shaft 30 is journalled in bearing 56 for rotation about an axis 58. The electric motor 24 includes an inner rotor core 60 mounted on shaft 30 and primary and start windings 62 mounted on the outer housing 50. A switch 64 is electrically connected to the windings 62 and has a moveable contact 66 to allow power from an external source (not shown) to be connected to the primary and start windings 62 as discussed in greater detail hereafter.

A centrifugal mechanism 68 is mounted on the motor shaft 30 via a press-fit collar 70. When the shaft 30 is stationary and the motor is not running, spring 72 biases the moveable cam member 74 and the two centrifugal arms 76 to the at-rest position shown in FIG. 2A. Each of the arms 76 includes a weight 78 located at its distal end to allow the cam member 74 to be disposed in the fully-extended position shown in FIG. 2B when the shaft rotates at a predetermined speed.

The body portion 80 of the unloader valve 38 includes a shoulder portion 82 mounted on the end flange 50 which is enclosed by a seal 84. The head portion 86 of the unloader valve 38 includes threads on its inner surface which mate with the threads on the outer surface of body portion 80. Conduit 40 is connected to the head portion 86 as shown. Unloader valve 38 includes a spring 88 which urges a valve stem 90 towards the closed position illustrated in FIG. 2B. A resilient actuator 92 is connected to the valve stem 90, contacts the moveable cam member 74, and is held in the position shown in FIG. 2B by the action of the spring 72 which overcomes the force applied to stem 90 by spring 88. Motor housing 48 includes openings (not shown) through which the compressed air released by the unloader valve 38 vents to atmosphere.

The air compressor system 10 operates as discussed hereafter. At system start-up when the tank 12 is empty, cam member 74 is disposed in the at-rest position, the unloader valve 38 is open, and the switch 64 is closed. In this configuration, power from an external source (not shown) may be connected to the primary and start windings 62 and the high pressure air from the compressor 26 vents directly to atmosphere through valve 38 so that no load is applied to the motor 24 while it is coming up to speed. While the motor 24 begins running and increases speed, the rotation of the shaft 30 causes the arms 76 of the centrifugal mechanism 68 to move outwardly towards the position shown in FIG. 2B. When the shaft 30 rotates at a predetermined speed, the arms 76 are disposed in the position shown in FIG. 2B in which the unloader valve 38 is closed and the switch 64 is opened. This action disconnects the start windings of the motor 24 from the external power source (not shown) and allows the air compressor 26 to fill the tank 12 with compressed air. When the pressure inside tank 12 reaches a desired level, then pressure switch 42 disconnects the motor 24 from the external power source (not shown).

During a steady-state off condition when the pressure inside the storage tank 12 is at a desired level, the unloader valve 38 and the contact 66 of switch 64 are disposed in the positions shown in FIG. 2A and the shaft 30 is stationary. If the pressure inside the tank 12 falls below this level, then the pressure switch 42 energizes the motor windings 62 and allows the tank 12 to be filled back up to the desired pressure level as discussed above.

While the invention has been illustrated and described in detail in the drawings and foregoing description, the same is considered as illustrative and not restrictive in character, it being understood that all changes and modification that come within the spirit of the invention are desired to be protected.

What is claimed is:

1. An air compressor system, comprising:

an electric motor, said motor including a rotatable shaft, a primary winding, and a start winding;

a centrifugal mechanism mounted on said shaft, said centrifugal mechanism having a cam member that is disposed in at-rest position when said shaft is stationary, that is moveable from said at-rest position in response to an increase in the rotational speed of said shaft, and that is disposed in an extended position when said shaft rotates at a predetermined speed;

an air compressor that is connected to an air storage container and that is operatively engaged with said shaft to allow compressed air to be supplied to said air storage container;

a switch that is electrically coupled to said primary and start windings, that is biased to a first position to allow power to be supplied to said primary and said start windings, and that is moveable to a second position to allow power to be supplied only to said primary winding;

a valve that communicates with said air storage container and that is biased to an open position;

wherein said valve and said switch are mechanically coupled to said cam member so that (1) when said shaft rotates at a speed below said predetermined speed, said cam member allows power to be supplied to said primary and start windings and allows said valve to remain in said open position thereby causing the air that is supplied to said air containing chamber by said air compressor to be vented from said air container chamber through said valve to atmosphere and (2) when said shaft rotates at said predetermined speed, said cam member is disposed in extended position thereby causing said switch to be disposed in said second position and said valve to be closed which stops the application of power to said start winding and causes said air compressor to fill said air storage container; and wherein the mechanical coupling of said valve and said switch to said cam member allows said motor to have a generally reduced size for a given application.

2. The air compressor system of claim 1 further comprising an adjustable relief valve connected to said air storage container, said adjustable relief valve allowing the compressed air contained in said air storage container to vent to atmosphere when the pressure in said air storage container rises above a predetermined level.

* * * * *